US005607213A

United States Patent [19]

Slivon et al.

[11] Patent Number: 5,607,213

[45] Date of Patent: Mar. 4, 1997

[54] SLIDING DRAWER TRAY

[75] Inventors: George R. Slivon, Kenosha, Wis.; Nick J. Theobald, Algona, Iowa

[73] Assignee: Snap-on Technologies, Inc., Crystal Lake, Ill.

[21] Appl. No.: 415,636

[22] Filed: Apr. 3, 1995

[51] Int. Cl.[6] ..... A47B 88/16

[52] U.S. Cl. ..... 312/301; 312/334.44; 312/308; 312/310; 312/902; 312/291; 312/351; 312/334.1; 312/298

[58] Field of Search ..... 312/295, 298, 312/301, 308, 310, 317.3, 304, 330.1, 334.1, 902, 291, 334.44, 351; 108/90, 44, 143

[56] References Cited

U.S. PATENT DOCUMENTS

| | | | |
|---|---|---|---|
| 1,060,215 | 4/1913 | Stoney . | |
| 1,182,637 | 5/1916 | Campbell . | |
| 1,582,556 | 4/1926 | Stuck | 312/334.11 |
| 1,622,422 | 6/1923 | Conwell et al. . | |
| 1,963,220 | 6/1934 | Anderson | 312/334.11 |
| 2,168,210 | 8/1939 | Hawksley . | |
| 2,328,019 | 8/1943 | Jones . | |
| 2,415,604 | 2/1947 | Nalley . | |
| 2,448,949 | 9/1948 | Baird . | |
| 2,511,919 | 6/1950 | Jones et al. . | |
| 2,576,385 | 11/1951 | Bigsby . | |
| 2,664,331 | 12/1953 | Glotfelter . | |
| 2,701,932 | 2/1955 | Hyman . | |
| 2,711,944 | 6/1995 | Meek et al. . | |
| 2,998,128 | 8/1961 | Larson . | |
| 3,160,448 | 12/1964 | Abernathy et al. . | |
| 3,241,900 | 3/1966 | Hamilton et al. . | |
| 3,449,033 | 6/1969 | Pipe | 312/334.11 |
| 3,488,097 | 1/1970 | Fall | 312/334.11 X |
| 3,519,319 | 7/1970 | Taylor . | |
| 3,899,982 | 8/1975 | Fetzek | 312/334.44 X |
| 3,919,949 | 11/1975 | Rendleman . | |
| 4,072,375 | 2/1978 | Boone . | |
| 4,102,470 | 7/1978 | Timmons . | |
| 4,120,549 | 10/1978 | Bureau . | |
| 4,184,725 | 1/1980 | Spangler . | |
| 4,190,306 | 2/1980 | Litchfield et al. | 312/334.44 X |
| 4,191,436 | 3/1980 | Cherry | 312/334.11 |
| 4,305,630 | 12/1981 | Mentlikowski et al. | 312/320 |
| 4,382,644 | 5/1983 | Brivio et al. | 312/334.11 |
| 4,440,461 | 4/1984 | Powell et al. . | |
| 4,582,372 | 4/1986 | Cooper . | |
| 4,600,255 | 7/1986 | Dubarko . | |

(List continued on next page.)

FOREIGN PATENT DOCUMENTS

| | | | |
|---|---|---|---|
| 1182637 | 6/1959 | France . | |
| 96636B | 11/1922 | Switzerland . | |
| 395212 | 12/1932 | United Kingdom . | |
| 789753 | 1/1958 | United Kingdom | 319/309 |

OTHER PUBLICATIONS

Snap–on Tools Corporation Catalog, pp. 16 and 31 (1992).
Snap–on Tools Corporation Catalog, p. 24 (1993).

*Primary Examiner*—James R. Brittain
*Assistant Examiner*—Stephen Vu
*Attorney, Agent, or Firm*—Emrich & Dithmar

[57] ABSTRACT

A sliding work platform for a drawer, of the type having upstanding front, rear and side walls, includes a substantially rectangular panel which defines a work surface and has front and rear edges and substantially flat side margins. The flat side margins slidably engage the tops of the upstanding side walls of the drawer to facilitate movement of the platform in the forward and rearward direction relative to the drawer. Support members are integrally coupled close to the rear edge of the panel for slidably engaging upper edges of drawer slides to support the platform rearwardly of the drawer. Downwardly depending flanges are integral with the panel side margins near the front edge of the panel to engage the insides of the drawer walls for limiting front-to-back and lateral movement of the platform relative to the drawer. Lips on the flanges engage beneath folded-over upper ends of the drawer side walls to inhibit vertical movement of the platform relative to the drawer.

10 Claims, 3 Drawing Sheets

U.S. PATENT DOCUMENTS 4,708,274 11/1987 Roche .
4,832,423 5/1989 Rapp .
5,037,165 8/1991 Rapp et al. .
5,044,059 9/1991 De Giulio .
5,044,780 9/1991 Termachi .
5,046,861 9/1991 Tarver .
5,156,367 10/1992 Wolfe .
5,222,780 6/1993 Reh et al. .
5,383,722 1/1995 Chen ..... 312/334.44 X
5,443,311 8/1995 Kadlecek et al. ..... 312/902 X
5,472,272 12/1995 Hoffman ..... 312/334.11

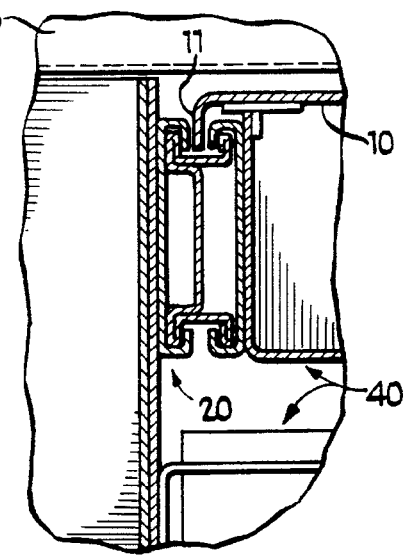
Fig 4
PRIOR ART
Fig 5
PRIOR ART
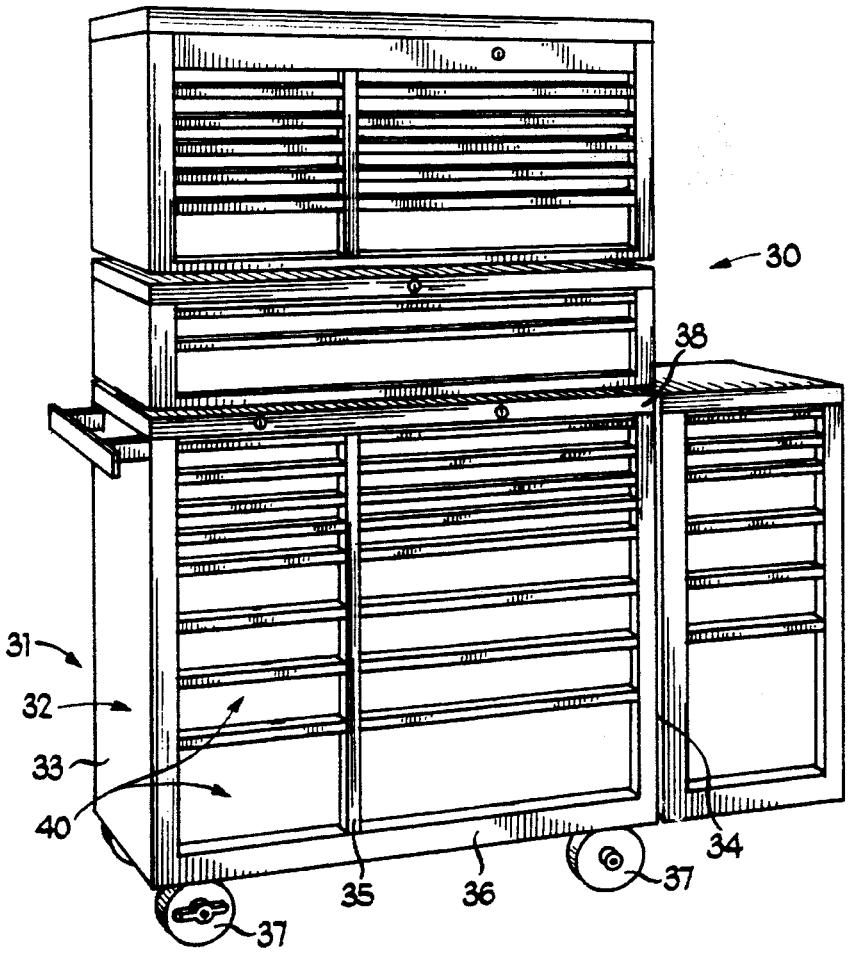

SLIDING DRAWER TRAY

BACKGROUND OF THE INVENTION

1. Field of the Invention

The present invention relates to work platforms or surfaces adapted for use with drawers and, in particular, to platforms which are supported on the drawer for movement therewith.

2. Description of the Prior Art

Recently, a pull-out work platform has been made available from Snap-on Incorporated under Model No. 3800K0800 (herein the "3800K platform") which is slidable supported on the drawer for movement between a forward position covering the entire drawer and a rearward position uncovering substantially the entire drawer when the drawer is open to permit access thereto. The 3800K platform shown by the reference numeral 10 in prior art FIGS. 1–4, includes depending side flanges 11 which ride along respective top channels of the offset runners of frictional type drawer slide assemblies 20 (see FIG. 4) and a rear flange 14. The 3800K platform 10 is the subject of a pending U.S. patent application Ser. No. 08/140,846 filed by Kadlecek et al. on Oct. 25, 1993, now U.S. Pat. No. 5,553,311. The flanges 11 on the 3800K platform 10 have a length substantially the same as the front-to-back depth of the drawer, extending from a rear edge 12 of the platform to a narrow channel-shaped tray 13 disposed along a front edge of the platform. The flanges 11 are both functional and necessary to maintain the platform aligned with the drawer as it is slid forward and rearward. Additionally, the channelled construction of the tray 13 facilitates grasping by the user's finger, as well as prevents the platform from being pushed rearwardly beyond the rear wall 45 of the drawer.

The platform 10 shown in FIGS. 1–4 is intended for use with a tool cabinet assembly 30 of the type generally shown in FIG. 5. The cabinet assembly 30 includes a roll cabinet module 31 having a housing 32 including upstanding side walls 33 and 34 and an intermediate wall 35 disposed between and substantially parallel to the side walls 33 and 34. The bottom edges of the walls 33–35 are interconnected by a bottom wall 36, from which depend four casters 37. The housing 32 is closed at the upper end thereof by a top wall 38. A rear wall (not shown) may also be provided in a known manner. The cabinet module 31 has a plurality of drawers 40 of various sizes, some of which are mounted between the side wall 33 and the intermediate wall 35 and some of which are mounted between the side wall 34 and the intermediate wall 35, all in a known manner. The platform 10 is coupled to a drawer 40 which, in turn, is connected to the cabinet assembly 30 by way of the frictional type drawer assembly 20 shown in FIG. 4.

While the construction of the 3800K platform 10 is generally quite simple, there remain a number of inherent functional and manufacturing disadvantages resulting from the construction of both the fanged and channelled features of the 3800K platform. First, because the flanges 11 run the whole length of the platform, on either side thereof, a significant amount of platform material is used other than as working surface. Secondly, because the gripping surface of the tray 13 rests below the surface of the work platform, the front of the platform of necessity comes with that much less of a working surface.

SUMMARY OF THE INVENTION

It is a general object of the invention to provide an improved work platform for use with a drawer which avoids the disadvantages of prior drawer-supported work platforms, while affording additional structural and operating advantages.

An important feature of the invention is the provision of a work platform of the type set forth which is of simple and economical construction.

Another feature of the invention is the provision of a drawer-supported work platform which affords a work surface having an area substantially the same as the area of the drawer.

Another feature of the invention is the provision of a work platform of the type set forth which is slidably supported on the drawer for movement between a forward position covering the entire drawer and a rearward position uncovering substantially the entire drawer to permit access thereto.

In connection with the foregoing feature, another feature of the invention is the provision of a work platform of the type set forth which remains fully supported when in its rearward, drawer-uncovering position.

These and other features of the invention are attained by providing a sliding work platform for a drawer of the type including upstanding front, rear and side walls. The platform includes a substantially rectangular panel which defines a work surface having front and rear edges and substantially flat side margins. The flat side margins are dimensioned to rest against the top of the upstanding side walls of the drawer to facilitate movement of the platform in the forward and rearward directions relative to the drawer. Support members are integrally coupled close to the rear edge of the panel for slidably engaging upper edges of drawer slides to insure support of the platform rearwardly of the drawer. Downwardly depending flanges are further integrally coupled to the panel for engagement with the drawer walls near the front edge for limiting forward and rearward movement of the panel and maintaining the panel aligned with the drawer.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 4 is an enlarged, fragmentary, sectional view showing the position of a flanged side of the 3800K platform coupled to a frictional type drawer slide assembly;

FIG. 5 is a front perspective view of a prior art tool cabinet having a plurality of drawers of the type with which work platforms, such as the 3800K and that of the present invention, can be used;

DETAILED DESCRIPTION OF THE PREFERRED EMBODIMENTS

Figure 1:
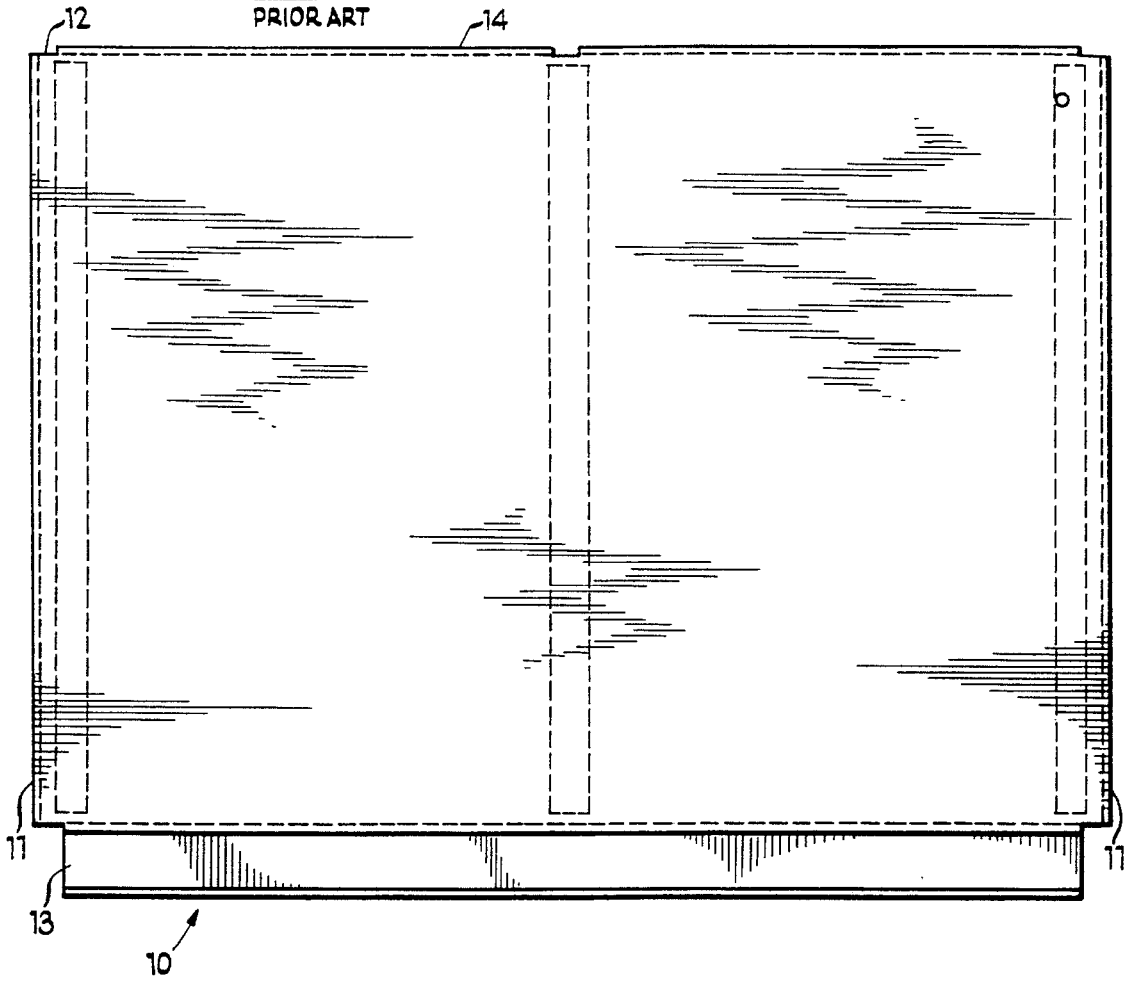
Fig 1 PRIOR ART
FIG. 1 is a top plan view of the 3800K (prior art) work platform.
Figure 2:
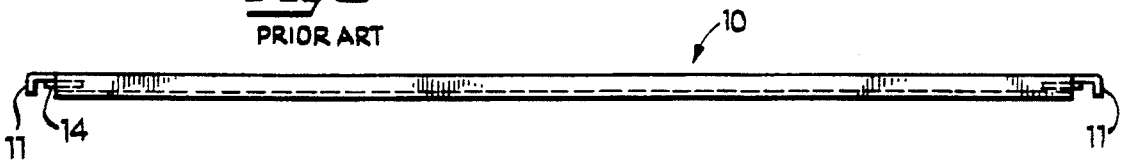
Fig 2 PRIOR ART
FIG. 2 is a front elevational view of the prior art work platform of FIG. 1.
Figure 3:
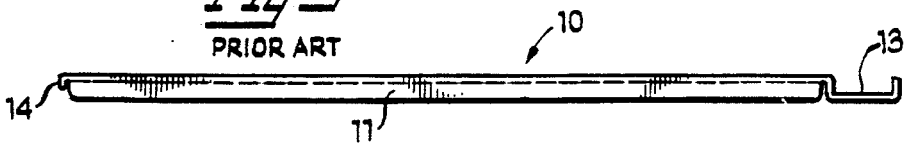
Fig 3 PRIOR ART
FIG. 3 is side elevational view of the left-hand side of the prior art work platform of FIG. 1.
Figure 6:
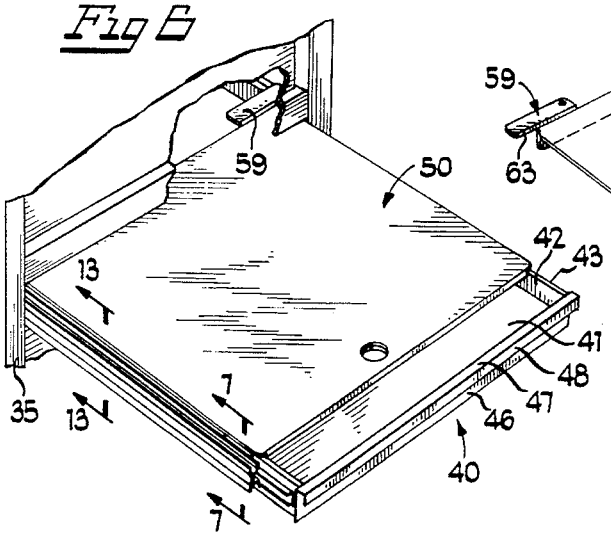
FIG. 6 is a fragmentary perspective view of a portion of the tool cabinet of FIG. 5, with a work platform in accordance with the present invention supported on one of the drawers, and with the drawer shown in its fully open position.
Figure 8:
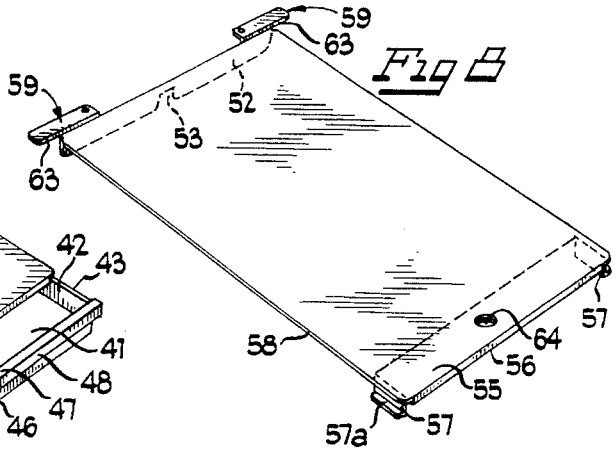
FIG. 8 is a front perspective view of the work platform of FIG. 6.
Figure 9:
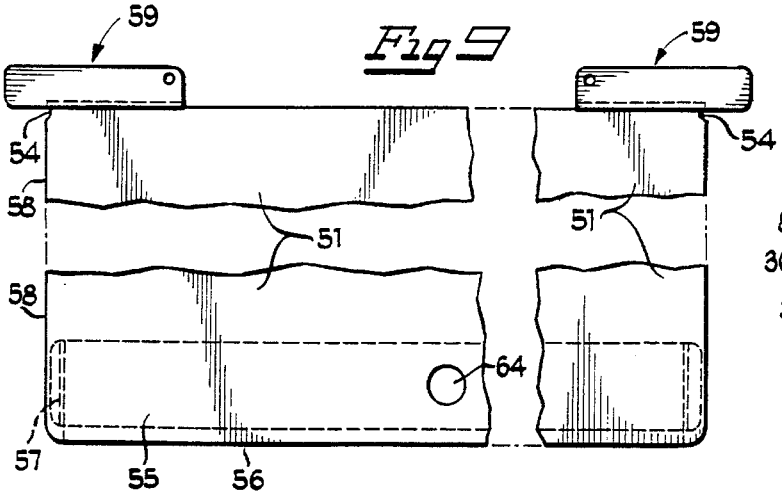
FIG. 9 is an enlarged, top plan view of the work platform of FIG. 8 with portions removed.
Figure 7:
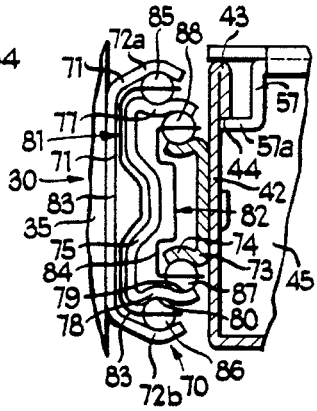
FIG. 7 is an enlarged fragmentary view showing the position of a flanged side of the work platform of the present invention coupled to a ball bearing type drawer assembly, and taken generally along the line 7—7 in FIG. 6.
Figure 10:
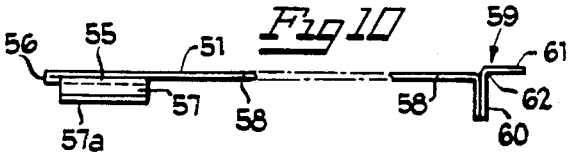
FIG. 10 is a side elevational view of the work platform of FIG. 9, as viewed from the right-hand side thereof.
Figure 11:
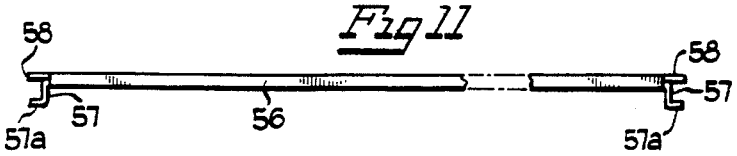
FIG. 11 is a front elevational view of the work platform of FIG. 9.
Figure 12:
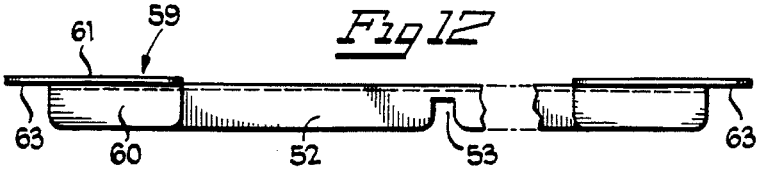
FIG. 12 is a rear elevational view of the work platform of FIG. 9.

Referring to FIGS. 6–7, there is illustrated a work platform 50 constructed in accordance with the present invention, supported on a drawer 40 of the type generally coupled to a tool cabinet 30 by way of a pair of drawer slide assemblies. The tool cabinet 30 and drawer 40 with which the present invention can be used are of the type generally shown in FIG. 5. Furthermore, the work platform 50 can be used with a frictional type, a ball-bearing type, or the like drawer slide assemblies, to be supported thereby in the manner to be described generally below.

The drawer 40 is of the type typically having a flat, rectangular bottom wall 41 integral at the opposite side edges thereof with upstanding side walls 42, each of which has an upper end thereof folded back on itself to define a rolled top edge 43 and an inverted shoulder 44. The drawer 40 also has an upstanding rear wall 45 and an upstanding front wall 46, which is preferably integral at the upper edge thereof with a forwardly projecting angle flange 47 provided at its distal end with a depending lip 48. It will be appreciated that the lip 48 facilitates grasping by the user's fingers to pull the drawer 40 to its open condition.

The drawer 40 is supported on the pair of drawer slide assemblies, which may be generally of the frictional type disclosed in U.S. Pat. No. 4,072,375, or more preferably, of the ball-bearing type, shown generally in FIG. 7 by the numeral 70. Drawer slide assemblies are conventionally and fundamentally of three part construction. A ball-bearing type slide assembly 70 includes a cabinet member 71 fixed to the associated cabinet wall (e.g., the intermediate wall 35) having the upper and lower edges 72*a*, 72*b* thereof bent to define ball engaging surfaces. Similarly, a drawer member 73 is fixed to the adjacent side wall 42 of the drawer 40 and has its upper and lower edges bent over to define ball engaging offsets 74. The assembly also includes an intermediate member 75 having an upstanding main wall 76, including an arched midsection, and having the upper and lower ends 77, 78 thereof bent in the direction of the drawer side wall 42. Each of the upper and lower ends 77, 78 of intermediate member 75 is curved to define partly-arcuate inner and outer surface areas 79, 80 which facilitate the coupling of the intermediate member 75 to the cabinet member 71 and the drawer member 73 using a cabinet ball race 81 and a drawer ball race 82. The ball races 81, 82 are of conventional construction and include respective ball positioning brackets 83, 84 bent along upper and lower ends thereof to support associated balls 85, 86 and 87, 88, respectively. In operation, the intermediate member 75 is reciprocatively slidable relative to each of the cabinet member 71 and the drawer member 73, aided by the rotation of balls 85–88, for facilitating movement of the drawer 40 between its open and closed conditions in a known manner.

While the present invention is described more fully below in connection with one type of drawer with a particular type of slide assembly coupled thereto, it will be appreciated that it could be used with any drawer which is supported by any drawer slide assembly having a cabinet member or the like with a longitudinal upper edge adjacent to the drawer side wall.

Referring now also to FIGS. 8–12, the platform 50 has a flat, rectangular panel 51 unitary at its rear edge with a depending rear flange 52. A rectangular central notch 53 may be provided in the lower edge of the rear flange 52 approximately midway between the ends thereof to provide clearance for a lock tab on the associated drawer 40 (not shown). The rear flange 52 does not extend the full width of the panel 51, and its ends terminate at corner notches 54 in the panel 51. Fixedly secured to the bottom surface of the panel 51 by suitable means, and preferably welded thereon, is a substantially flat surface member 55 which extends laterally across the panel 51 near a front edge 56 thereof. The respective opposed ends of the flat surface member 55 are curved to define downwardly depending flanges 57 with outturned lips 57*a* at the distal ends thereof which are substantially parallel with side margins 58 of panel 51.

Integrally attached to the panel 51 at the rear end thereof are corner support members 59, each in the form of an angle bracket consisting of two substantially flat flanges 60, 61 at right angles to each other. The flanges 60 are substantially equal in height to the rear flange 52 and are fixedly secured to the outer surface thereof in back-to-back engagement, respectively adjacent to the ends of the rear flange 52. The flanges 61 extend from top edges 62 of respective vertical flanges 60. The bottom surfaces of the horizontal flat flanges 61 are approximately coplanar with the upper surface of the panel 51 and extend both rearwardly from the rear edge of panel 51 and laterally outboard therefrom beyond the side margins 58 of the panel 51. The ends of horizontal flat flanges 61 define bottom edge surfaces 63.

Furthermore, a hole 64 is formed through the center of flat surface member 55 and through the panel 51 midway between the flanges 57 to facilitate grasping of the panel 51, by a user's finger, for sliding movement thereof in the forward and rearward directions.

Figure 13:
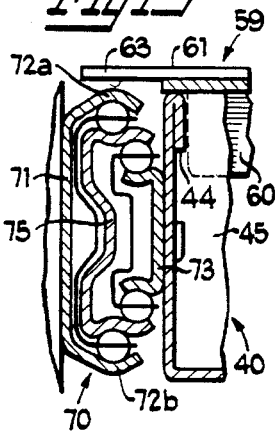
FIG. 13 is a view similar to the view of FIG. 7 but taken generally along the line 13—13 in FIG. 6.

Referring back to FIG. 7, in use, the work platform 50 is supported on the drawer 40. More specifically, the panel 51 spans the drawer 40 so that the side margins 58 respectively overlie the top edges 43 of the drawer side walls 42 for slidable engagement therewith as the platform 50 is opened and closed. Flanges 57 are sized so that the lips 57*a* respectively fit below the associated inverted shoulders 44 on the inside of the drawer side walls 42 for cooperation with the side margins 58 to inhibit vertical movement of the platform 50 relative to the drawer 40. The bottom surfaces 63 of support members 59 overlie the upper edges 72a of the cabinet members 71 of the drawer slide assemblies 70, such that as the work platform 50 is pushed rearwardly relative to the drawer 40 (see FIG. 13), the rear of the platform 50 will tilt slightly, under its own weight, until bottom surfaces 63 make contact with top edges 72*a* of the cabinet members 71, thus inhibiting further lateral tilting of the platform 50 and maintaining it substantially in alignment with the drawer 40 at all times.

Thus, it will be appreciated that the work platform 50 is fully supported on the drawer 40 for movement therewith, and is also slidably movable forwardly and rearwardly relative to the drawer 40. Preferably, the work platform 50 is sized so that when it is in its forwardmost position relative to the drawer 40, it completely covers the drawer 40, thereby affording the maximum work surface area. When access to the drawer 40 is desired, the drawer 40 is opened the desired amount and the work platform 50 is slid rearwardly the desired distance to access the drawer contents.

It is a significant aspect of the invention that the work platform 50 remains fully supported in all positions. Thus, for example, when the drawer 40 is pulled all the way out to its fully open position, and it is desired to access the entire area of the drawer 40, the work platform 50 must be pushed all the way back until the flanges 57 abut the rear wall 45 of the drawer 40. In this position, the side-margins 58 of the work platform 50 project rearwardly well beyond the rear end of the drawer 40. Nevertheless, the rear end of the panel 51 is supported by the abutting engagement of the flanges 61 of support members 59 with the top edges 72*a* of cabinet members 71.

In a constructional model of the invention, the work platform 50 is formed of a suitable metal, such as steel, and is preferably of integral multi-piece construction. However, it will be appreciated that other materials and fabrication techniques could be utilized.

From the foregoing, it can be seen that there has been provided an improved work platform which is slidably supported on a drawer for movement therewith and for sliding movement relative thereto, the work platform covering the entire area of the drawer and being slidable to an open position exposing substantially the full area of the drawer, while remaining fully supported.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A sliding work platform for a drawer of the type including upstanding front, rear and side walls and supported on drawer slides, the platform comprising:

a substantially rectangular panel defining a work surface and having front and rear edges and substantially flat side margins, said flat side margins being disposed for respective sliding engagement with upper edges of the upstanding side walls of the drawer to facilitate sliding movement of said platform in forward and rearward directions relative to the drawer;

support members integral with said panel only adjacent to the rear edge thereof for respective sliding engagement with upper edges of the drawer slides to support portions of said platform extending rearwardly of the drawer; and depending flanges integral with said side margins only adjacent to the front edge of said panel for engagement with the drawer walls inside the drawer to limit movement of said panel relative to the drawer.

2. The apparatus of claim 1, wherein said panel includes a rear flange depending from the rear edge of said panel, and a notch formed in said rear flange midway between the side margins of the panel to provide clearance for an associated drawer lock tab.

3. The platform of claim 1, further including a hole formed near the front edge of said panel approximately midway between the flanges to facilitate grasping of the panel by a user's finger for sliding.

4. The platform of claim 3, wherein said depending flanges are formed from a single flat member extending substantially the width of the panel and integral therewith and having opposed ends thereof bent to define said flanges.

5. The platform of claim 4, wherein said hole extends vertically through the single flat member so as to provide a large gripping area for the user's finger.

6. The platform of claim 1, wherein said depending flanges are formed from a single flat member extending substantially the width of the panel and integral therewith and having opposed ends thereof bent to define said flanges.

7. The platform of claim 4, wherein said support members and said single flat member are welded to said panel.

8. The platform of claim 1, wherein said platform is dimensioned for support by a ball bearing type drawer slide assembly.

9. The platform of claim 1, wherein said platform is dimensioned for support by a frictional type drawer slide assembly.

10. A sliding work platform for a drawer of the type including upstanding front, rear and side walls and supported on drawer slides, wherein each of the drawer side walls is greater in thickness at the top portion thereof than at a bottom portion thereof so as to provide an inner shoulder between the top and bottom portions, the platform comprising:

a substantially rectangular panel defining a work surface and having front and rear edges and substantially flat side margins, said flat side margins being disposed for respective sliding engagement with upper edges of the upstanding side walls of the drawer to facilitate sliding movement of said platform in forward and rearward directions relative to the drawer;

support members integral with said panel adjacent to the rear edge thereof for respective sliding engagement with upper edges of the drawer slides to support portions of said platform extending rearwardly of the drawer; and depending flanges integral with said side margins adjacent to the front edge of said panel for engagement with the drawer walls inside the drawer to limit movement of said panel relative to the drawer, each of said flanges including a lip dimensioned to extend below the associated shoulder for engagement therewith to thereby prevent upward motion of said panel about said flanges.

* * * * *